US009835004B2

(12) United States Patent
Keerthivasan et al.

(10) Patent No.: US 9,835,004 B2
(45) Date of Patent: Dec. 5, 2017

(54) MULTI-ZONE ACTUATION SYSTEM USING WELLBORE DARTS

(71) Applicant: Halliburton Energy Services, Inc., Houston, TX (US)

(72) Inventors: Vijay Kumar Keerthivasan, Singapore (SG); Ryan Zhe Cong Foong, Shal Alam (MY); Matthew Todd Howell, Duncan, OK (US); Zachary William Walton, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 290 days.

(21) Appl. No.: 14/423,154

(22) PCT Filed: Apr. 16, 2014

(86) PCT No.: PCT/US2014/034347
§ 371 (c)(1),
(2) Date: Feb. 23, 2015

(87) PCT Pub. No.: WO2015/160342
PCT Pub. Date: Oct. 22, 2015

(65) Prior Publication Data

US 2016/0251923 A1 Sep. 1, 2016

(51) Int. Cl.
*E21B 23/08* (2006.01)
*E21B 34/14* (2006.01)
(Continued)

(52) U.S. Cl.
CPC ..... *E21B 23/08* (2013.01); *E21B 33/12* (2013.01); *E21B 34/063* (2013.01); *E21B 34/14* (2013.01);
(Continued)

(58) Field of Classification Search
CPC ..... E21B 23/08; E21B 34/14; E21B 34/063; E21B 33/12; E21B 43/14; E21B 43/26; E21B 2034/007
See application file for complete search history.

(56) References Cited

U.S. PATENT DOCUMENTS 7,325,617 B2 * 2/2008 Murray ..... E21B 23/02 166/153
2004/0118564 A1 6/2004 Themig et al.
(Continued)

FOREIGN PATENT DOCUMENTS

WO 2015160342 A1 10/2015

OTHER PUBLICATIONS

International Search Report and Written Opinion for PCT/US2014/034347 dated Jan. 16, 2015.

*Primary Examiner* — Jennifer H Gay
(74) *Attorney, Agent, or Firm* — McDermott Will & Emery LLP

(57) ABSTRACT

Disclosed is a sliding sleeve assembly that includes a sliding sleeve sub coupled to a work string extended within a wellbore, the sliding sleeve sub having one or more ports defined therein that enable fluid communication between an interior and an exterior of the work string, a sliding sleeve arranged within the sliding sleeve sub and movable between a closed position, where the sliding sleeve occludes the one or more ports, and an open position, where the sliding sleeve has moved to expose the one or more ports, a sleeve profile defined on an inner surface of the sliding sleeve, a wellbore dart having a body and a plurality of collet fingers extending longitudinally from the body, and a dart profile defined on an outer surface of the plurality of collet fingers, the dart profile being configured to selectively mate with the sleeve profile.

22 Claims, 4 Drawing Sheets

(51) Int. Cl.

| | |
|---|---|
| ***E21B 33/12*** | (2006.01) |
| ***E21B 43/14*** | (2006.01) |
| ***E21B 34/06*** | (2006.01) |
| *E21B 34/00* | (2006.01) |

(52) U.S. Cl.
CPC ..... *E21B 43/14* (2013.01); *E21B 2034/007* (2013.01)

(56) References Cited

U.S. PATENT DOCUMENTS

2005/0103504 A1* 5/2005 Szarka ..... E21B 33/16 166/386
2006/0124310 A1* 6/2006 Lopez de Cardenas ..... E21B 34/06 166/313
2007/0044958 A1* 3/2007 Rytlewski ..... C09K 8/68 166/250.01
2009/0084553 A1 4/2009 Rytlewski et al.
2011/0114334 A1 5/2011 Palacios
2011/0198096 A1 8/2011 Mailand et al.
2012/0073828 A1* 3/2012 Churchill ..... E21B 21/103 166/373
2013/0112435 A1* 5/2013 Fleming ..... E21B 34/14 166/386
2013/0112436 A1* 5/2013 Fleming ..... E21B 23/006 166/386
2013/0206402 A1* 8/2013 Coon ..... E21B 23/08 166/255.1
2014/0060837 A1* 3/2014 Love ..... E21B 43/26 166/297
2015/0361747 A1* 12/2015 Lafferty ..... E21B 34/14 166/373
2016/0251923 A1* 9/2016 Keerthivasan ..... E21B 23/08 166/383
2016/0258259 A1* 9/2016 Walton ..... E21B 34/14
2016/0258260 A1* 9/2016 Walton ..... E21B 34/06
2016/0298422 A1* 10/2016 Hyde, Jr. ..... E21B 43/14
2016/0312581 A1* 10/2016 Nordheimer ..... E21B 33/146
2016/0369083 A1* 12/2016 Khatiwada ..... C08K 3/34

* cited by examiner

MULTI-ZONE ACTUATION SYSTEM USING WELLBORE DARTS

BACKGROUND

The present disclosure relates generally to wellbore operations and, more particularly, to a wellbore dart and multi-zone actuation system used in carrying out multiple-interval stimulation of a wellbore.

In the oil and gas industry, subterranean formations penetrated by a wellbore are often fractured or otherwise stimulated in order to enhance hydrocarbon production. Fracturing and stimulation operations are typically carried out by strategically isolating various zones of interest (or intervals within a zone of interest) in the wellbore using packers and the like, and then subjecting the isolated zones to a variety of treatment fluids at increased pressures. In a typical fracturing operation for a cased wellbore, the casing cemented within the wellbore is first perforated to allow conduits for hydrocarbons within the surrounding subterranean formation to flow into the wellbore. Prior to producing the hydrocarbons, however, treatment fluids are pumped into the wellbore and the surrounding formation via the perforations, which has the effect of opening and/or enlarging drainage channels in the formation, and thereby enhancing the producing capabilities of the well.

Today, it is possible to stimulate multiple zones during a single stimulation operation by using onsite stimulation fluid pumping equipment. In such applications, several wellbore isolation devices or "packers" are introduced into the wellbore and each packer is strategically located at predetermined intervals configured to isolate adjacent zones of interest. Each zone may include a sliding sleeve that is moved to permit zonal stimulation by diverting flow through one or more tubing ports occluded by the sliding sleeve. Once the packers are appropriately deployed, the sliding sleeves may be shifted open remotely from the surface by using a ball and baffle system. The ball and baffle system involves sequentially dropping wellbore projectiles, commonly referred to as "frac balls," of predetermined sizes to seal against correspondingly sized baffles or seats disposed within the wellbore at corresponding zones of interest. The smaller frac balls are introduced into the wellbore prior to the larger frac balls, where the smallest frac ball is designed to land on the baffle furthest in the well, and the largest frac ball is designed to land on the baffle closest to the surface of the well. Accordingly, the frac balls isolate the target sliding sleeves, from the bottom-most sleeve moving uphole. Applying hydraulic pressure from the surface serves to shift the target sliding sleeve to its open position.

Thus, the ball and baffle system acts as an actuation mechanism for shifting the sliding sleeves to their open position downhole. When the fracturing operation is complete, the balls can be either hydraulically returned to the surface or drilled up along with the baffles in order to return the casing string to a full bore inner diameter. As can be appreciated, at least one shortcoming of the ball and baffle system is that there is a limit to the maximum number of zones that may be fractured owing to the fact that the baffles are of graduated sizes.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to wellbore operations and, more particularly, to a wellbore dart and multi-zone actuation system used in carrying out multiple-interval stimulation of a wellbore.

Disclosed are embodiments of a sliding sleeve actuation system that includes a wellbore dart configured to selectively mate with a predetermined sliding sleeve of a sliding sleeve assembly. More particularly, the wellbore dart may define or otherwise provide a selective profile configured to engage a corresponding selective profile defined on the inner diameter of a sliding sleeve. The dart is pumped downhole and, upon locating the correct sliding sleeve, selectively engages the profile defined on the inner diameter of the sliding sleeve. The wellbore dart seals against a seal bore of the sliding sleeve such that an increase in fluid pressure following selective engagement serves to shift the sliding sleeve to an open position. Advantageously, the wellbore dart bypasses sliding sleeves that do not exhibit a matching selective profile.

The selective engagement between preconfigured wellbore darts and sliding sleeves, as described herein, enables the use of just a single size of sealing diameter and dart system across all zones. This selectivity removes the limitation on the maximum number of zones that may be fractured in a multistage fracture completion operation since, using the embodiments disclosed herein, a fracture sleeve assembly can exhibit a single inner diameter across all the zones and depths. As a result, there is no need for a tapered layout of the inner diameters of the multistage fracture completion system, and the limitation on the maximum number of zones that may be fractured is essentially eliminated. Moreover, with the implementation of a dissolvable and/or degradable material in the wellbore darts, the present disclosure also presents an intervention-less method to achieve a full-bore inner diameter following stimulation operations.

Figure 1:
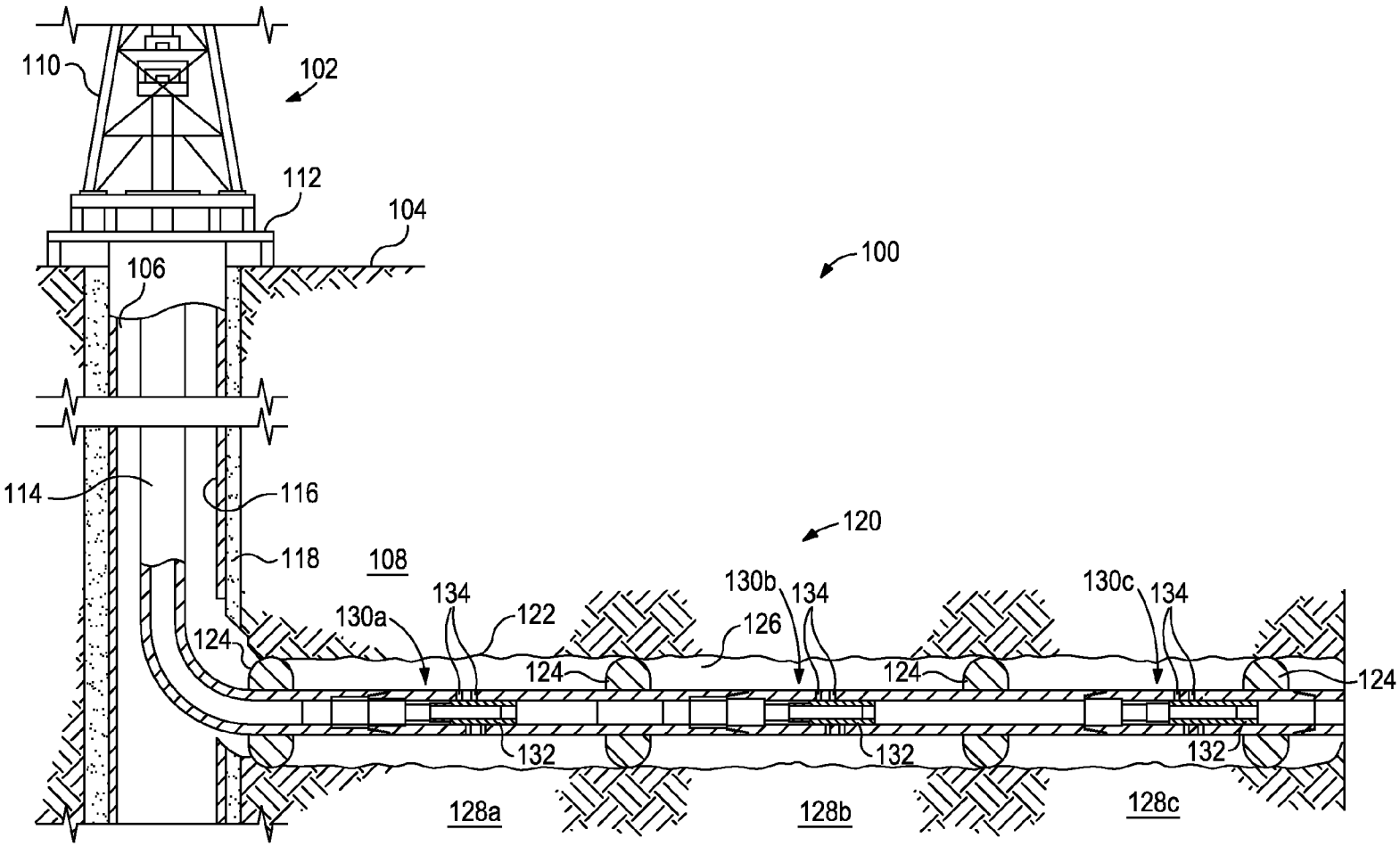
FIG. 1 illustrates an exemplary well system that can embody or otherwise employ one or more principles of the present disclosure, according to one or more embodiments.

Referring to FIG. 1, illustrated is an exemplary well system 100 which can embody or otherwise employ one or more principles of the present disclosure, according to one or more embodiments. As illustrated, the well system 100 may include an oil and gas rig 102 arranged at the Earth's surface 104 and a wellbore 106 extending therefrom and penetrating a subterranean earth formation 108. Even though FIG. 1 depicts a land-based oil and gas rig 102, it will be appreciated that the embodiments of the present disclosure are equally well suited for use in other types of rigs, such as offshore platforms, or rigs used in any other geographical location. In other embodiments, the rig 102 may be replaced with a wellhead installation, without departing from the scope of the disclosure.

The rig 102 may include a derrick 110 and a rig floor 112. The derrick 110 may support or otherwise help manipulate the axial position of a work string 114 extended within the wellbore 106 from the rig floor 112. As used herein, the term "work string" refers to one or more types of connected lengths of tubulars or pipe such as drill pipe, drill string, landing string, production tubing, coiled tubing combinations thereof, or the like. The work string 114 may be utilized in drilling, stimulating, completing, or otherwise servicing the wellbore 106, or various combinations thereof.

As illustrated, the wellbore 106 may extend vertically away from the surface 104 over a vertical wellbore portion. In other embodiments, the wellbore 106 may otherwise deviate at any angle from the surface 104 over a deviated or horizontal wellbore portion. In other applications, portions or substantially all of the wellbore 106 may be vertical, deviated, horizontal, and/or curved. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the heel or surface of the well and the downhole direction being toward the toe or bottom of the well.

In an embodiment, the wellbore 106 may be at least partially cased with a casing string 116 or may otherwise remain at least partially uncased. The casing string 116 may be secured within the wellbore 106 using, for example, cement 118. In other embodiments, the casing string 116 may be only partially cemented within the wellbore 106 or, alternatively, the casing string 116 may be omitted from the well system 100, without departing from the scope of the disclosure. The work string 114 may be coupled to a completion assembly 120 that extends into a branch or lateral portion 122 of the wellbore 106. As illustrated, the lateral portion 122 may be an uncased or "open hole" section of the wellbore 106. It is noted that although FIG. 1 depicts the completion assembly 120 as being arranged within the lateral portion 122 of the wellbore 106, the principles of the apparatus, systems, and methods disclosed herein may be similarly applicable to or otherwise suitable for use in wholly vertical wellbore configurations. Consequently, the horizontal or vertical nature of the wellbore 106 should not be construed as limiting the present disclosure to any particular wellbore 106 configuration.

The completion assembly 120 may be arranged or otherwise deployed within the lateral portion 122 of the wellbore 106 using one or more packers 124 or other wellbore isolation devices known to those skilled in the art. The packers 124 may be configured to seal off an annulus 126 defined between the completion assembly 120 and the inner wall of the wellbore 106. As a result, the subterranean formation 108 may be effectively divided into multiple intervals or "pay zones" 126 (shown as intervals 128*a*, 128*b*, and 128*c*) which may be stimulated and/or produced independently via isolated portions of the annulus 126 defined between adjacent pairs of packers 124. While only three intervals 128*a-c* are shown in FIG. 1, those skilled in the art will readily recognize that any number of intervals 128*a-c* may be defined or otherwise used in the well system 100, including a single interval, without departing from the scope of the disclosure.

The completion assembly 120 may include one or more sliding sleeve assemblies 130 (shown as sliding sleeve assemblies 130*a*, 130*b*, and 130*c*) arranged in, coupled to, or otherwise forming integral parts of the work string 114. As illustrated, at least one sliding sleeve assembly 130*a-c* may be arranged in each interval 128*a-c*, but those skilled in the art will readily appreciate that more than one sliding sleeve assembly 130*a-c* may be arranged therein, without departing from the scope of the disclosure. It should be noted that, while the sliding sleeve assemblies 130*a-c* are shown in FIG. 1 as being employed in an open hole section of the wellbore 106, the principles of the present disclosure are equally applicable to completed or cased sections of the wellbore 106. In such embodiments, a cased wellbore 106 may be perforated at predetermined locations in each interval 128*a-c* using any known methods (e.g., explosives, hydrajetting, etc.) in the art. Such perforations serve to facilitate fluid conductivity between the interior of the work string 114 and the surrounding intervals 128*a-c* of the formation 108.

Each sliding sleeve assembly 130*a-c* may be actuated in order to provide fluid communication between the interior of the work string 114 and the annulus 126 adjacent each corresponding interval 128*a-c*. As depicted, each sliding sleeve assembly 130*a-c* may include a sliding sleeve 132 that is axially movable within the work string 114 to expose one or more ports 134 defined in the work string 114. Once exposed, the ports 134 may facilitate fluid communication between the annulus 126 and the interior of the work string 114 such that stimulation and/or production operations may be undertaken in each corresponding interval 128*a-c* of the formation 108.

According to the present disclosure, in order to move the sliding sleeve 132 of a given sliding sleeve assembly 130*a-c* to its open position, and thereby expose the corresponding ports 134, a wellbore dart (not shown) may be introduced into the work string 114 and conveyed to the given sliding sleeve assembly 130*a-c*. In some embodiments, the wellbore dart can be dropped through the work string 114 from the surface 104 until locating the proper sliding sleeve assembly 130*a-c*. In other embodiments, the wellbore dart may be pumped through the work string 114, conveyed by wireline, slickline, coiled tubing, etc., or it may be self-propelled into the wellbore until locating the proper sliding sleeve assembly 130*a-c*. In yet other embodiments, a combination of the preceding techniques may be employed to convey to the wellbore dart to the proper sliding sleeve assembly 130*a-c*. As described in more detail below, the wellbore dart may have a unique selective profile defined on its outer surface that is configured to mate with a complementary profile defined on the inner surface of the sliding sleeve 132. Once the selective and complementary profiles mate, the fluid pressure within the work string 114 may be increased to shift the sliding sleeve 132 to its open position.

Figure 2A:
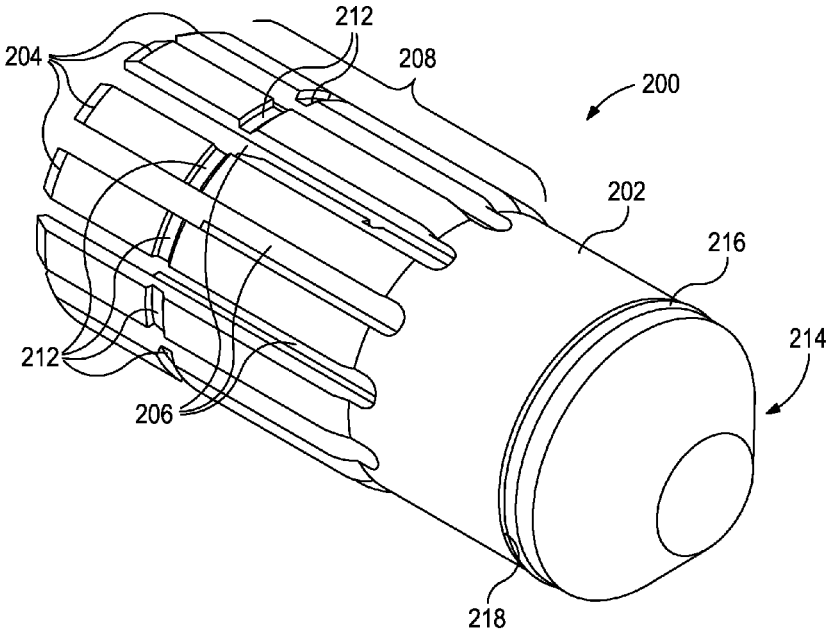
FIGS. 2A and 2B illustrate isometric and cross-sectional side views, respectively, of an exemplary wellbore dart, according to one or more embodiments of the present disclosure.
Figure 2B:
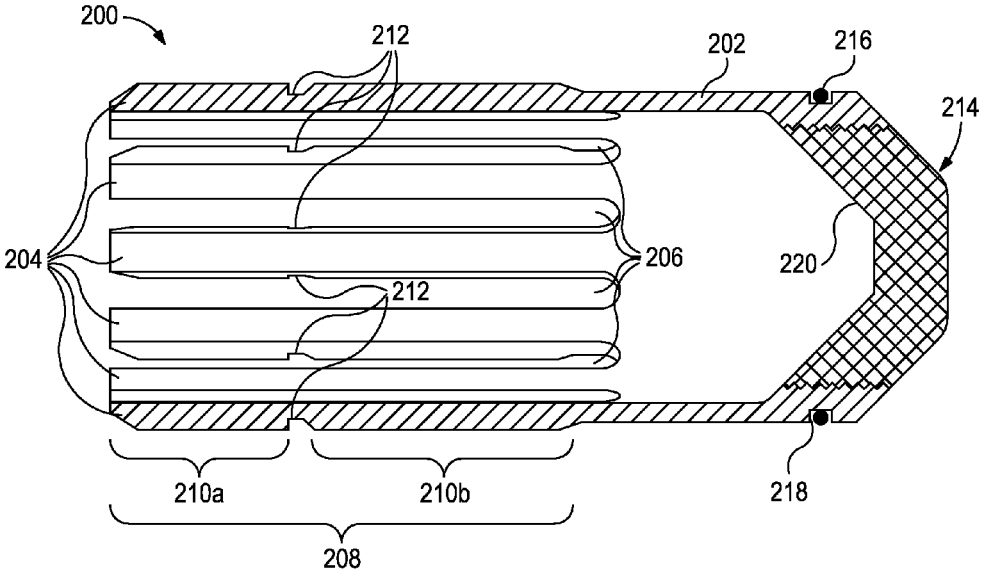

Referring now to FIGS. 2A and 2B, with continued reference to FIG. 1, illustrated is an exemplary wellbore dart 200, according to one or more embodiments of the present disclosure. More particularly, FIG. 2A depicts an isometric view of the wellbore dart 200, and FIG. 2B depicts a cross-sectional side view of the wellbore dart 200. As illustrated, the wellbore dart 200 may include a generally cylindrical body 202 with a plurality of collet fingers 204 either forming part of the body 202 or extending longitudinally therefrom. The body 200 may be made of a variety of materials including, but not limited to, iron and iron alloys, steel and steel alloys, aluminum and aluminum alloys, copper and copper alloys, plastics, composite materials, and any combination thereof. In other embodiments, as described in greater detail below, all or a portion of the body 202 may be made of a degradable and/or dissolvable material, without departing from the scope of the disclosure.

In at least one embodiment, the collet fingers 204 may be flexible, axial extensions of the body 202 that are separated by elongate channels 206. A dart profile 208 may be defined on the outer radial surface of the collet fingers 204. The dart profile 208 may include or otherwise provide various features, designs, and/or configurations in order to enable the wellbore dart 200 to mate with a pre-selected or desired sliding sleeve (not shown). For instance, as best seen in FIG. 2B, the dart profile 208 may include a first collet section 210*a* encompassing a first axial length of the collet fingers 204, and a second collet portion 210*b* encompassing a second axial length of the collet fingers 204. The first and second collet portions 210*a,b* may be separated from each other by a groove 212 defined in the collet fingers 204.

The first and second collet portions 210*a,b* may exhibit any predetermined or desired length in order to selectively mate with a correspondingly-shaped or configured sleeve profile defined on a desired sliding sleeve. Accordingly, while the first collet portion 210*a* is depicted as exhibiting a particular first axial length and the second collet portion 210*b* is depicted as exhibiting a particular second axial length, the groove 212 may be defined or otherwise arranged at any axial location along the collet fingers 204 in order to effect a proper mating relationship between the dart profile 208 and a corresponding sleeve profile.

Moreover, while only one groove 212 is depicted in FIGS. 2A and 2B, those skilled in the art will readily appreciate that more than one groove 212 may be defined on the outer surface of the collet fingers 204, without departing from the scope of the disclosure. In such embodiments, the number of collet portions 210*a,b* would also increase proportionally. In other embodiments, the one or more grooves 212 may be replaced with one or more radial protrusions that extend radially outward from the outer radial surface of the collet fingers 204. In yet other embodiments, a combination of one or more grooves and one or more radial protrusions may be used in the dart profile 208, without departing from the scope of the disclosure. In even further embodiments, the collet fingers 204 may be replaced with spring-loaded keys, similar to those used in lock mandrels or the like, and used to selectively locate sleeves. Accordingly, the dart profile 208 may exhibit a variety of different designs and/or configurations in order to allow the wellbore dart 200 to be selectively matable with a correspondingly configured sleeve profile of a sliding sleeve.

The wellbore dart 200 may further include a dynamic seal 216 arranged about the exterior or outer surface of the body 202 at or near its downhole end 214. As used herein, the term "dynamic seal" is used to indicate a seal that provides pressure and/or fluid isolation between members that have relative displacement therebetween, for example, a seal that seals against a displacing surface, or a seal carried on one member and sealing against the other member. In some embodiments, the dynamic seal 216 may be arranged within a groove 218 defined on the outer surface of the body 202. As described in greater detail below, the dynamic seal 216 may be configured to "dynamically" seal against a seal bore of a sliding sleeve (not shown).

The dynamic seal 216 may be made of a material selected from the following: elastomeric materials, non-elastomeric materials, metals, composites, rubbers, ceramics, derivatives thereof, and any combination thereof. In some embodiments, the dynamic seal 216 may be an O-ring or the like, as illustrated. In other embodiments, however, the dynamic seal 216 may be a set of v-rings or CHEVRON® packing rings, or other appropriate seal configurations (e.g., seals that are round, v-shaped, u-shaped, square, oval, t-shaped, etc.), as generally known to those skilled in the art, or any combination thereof.

Figure 3A:
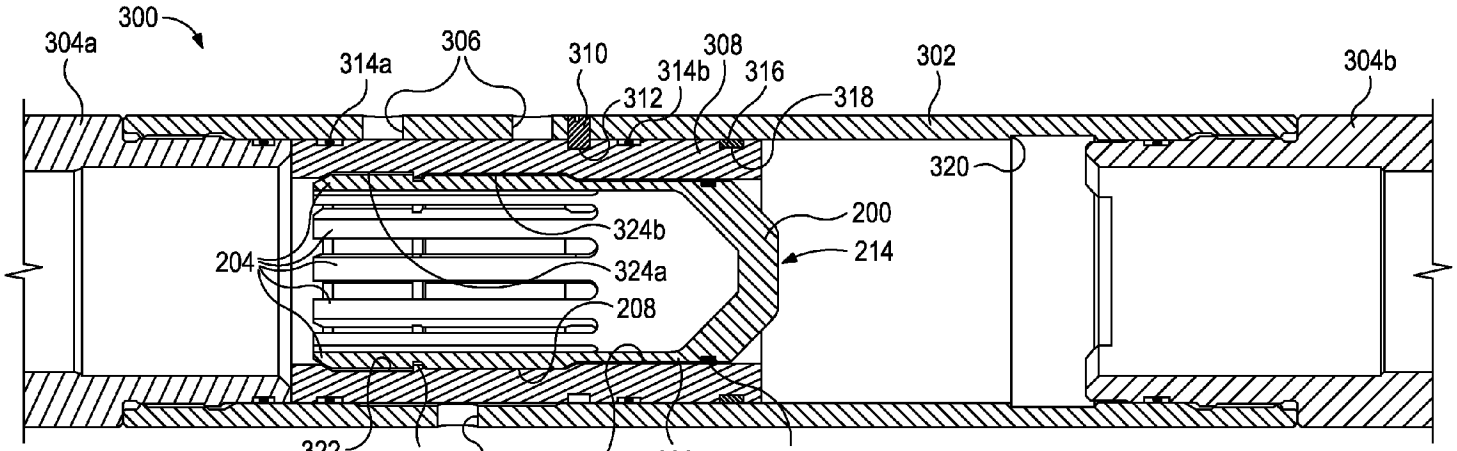
FIGS. 3A and 3B illustrate progressive cross-sectional side views of an exemplary sliding sleeve assembly, according to one or more embodiments.
Figure 3B:
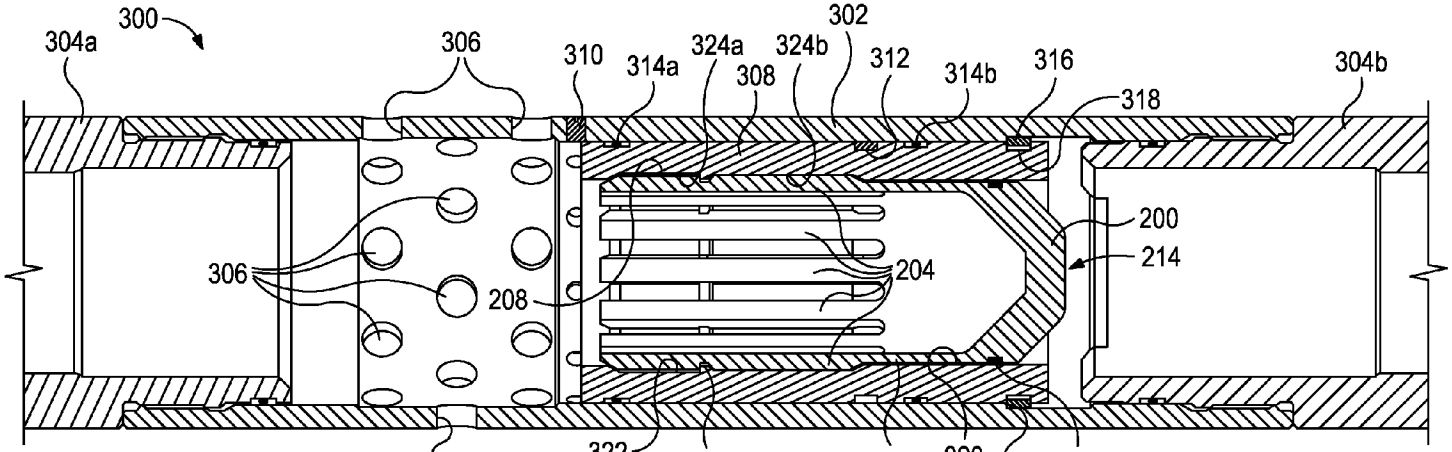

Referring now to FIGS. 3A and 3B, with continued reference to FIGS. 1 and 2A-2B, illustrated are progressive cross-sectional side views of an exemplary sliding sleeve assembly 300, according to one or more embodiments. The sliding sleeve assembly 300 (hereafter "the assembly 300") may be similar to (or the same as) any one of the sliding sleeve assemblies 130*a-c* of FIG. 1. FIG. 3A depicts the assembly 300 in a closed configuration, and FIG. 3B depicts the assembly 300 in an open configuration.

As illustrated, the assembly 300 may include a sliding sleeve sub 302 that may be coupled to or otherwise form an integral part of the work string 114 (FIG. 1). In FIGS. 3A-3B, the sliding sleeve sub 302 (hereafter "the sub 302") is depicted as being operatively coupled at its uphole end to an upper work string portion 304*a*, and at its downhole end to a lower work string portion 304*b*, where the upper and lower work string portions 304*a,b* form parts of the work string 114. One or more ports 306 may be defined through the sub 302, and may be similar to the ports 134 of FIG. 1. Accordingly, the ports 306 may enable fluid communication between the interior of the sliding sleeve assembly 300 (and the work string 114) and a surrounding subterranean formation (e.g., the formation 108 of FIG. 1).

The assembly 300 may further include a sliding sleeve 308 arranged within the sub 302. The sliding sleeve 308 may be similar to (or the same as) any one of the sliding sleeves 132 of FIG. 1. In FIG. 3A, the sliding sleeve 308 is depicted in a closed position, where the sliding sleeve 308 generally occludes the ports 306 and thereby prevents fluid communication therethrough. In FIG. 3B, the sliding sleeve 308 is depicted in an open position, where the sliding sleeve 308 has moved axially within the sub 302 to expose the ports 306 and thereby facilitate fluid communication through the ports 306.

In some embodiments, the sliding sleeve 308 may be secured in the closed position with one or more shearable devices 310. In the illustrated embodiment, the shearable device 310 may include one or more shear pins that extend from the sub 302 and into corresponding blind bores 312 defined on the outer surface of the sliding sleeve 308. In other embodiments, the shearable device 310 may be a shear ring or any other device or mechanism configured to shear or otherwise fail upon assuming a predetermined shear load applied to the sliding sleeve 308.

The sliding sleeve 308 may further include one or more dynamic seals 314 (two shown as dynamic seals 314*a* and 314*b*) arranged between the outer surface of the sliding sleeve 308 and the inner surface of the sub 302. The dynamic seals 314*a,b* may be configured to provide fluid isolation between the sliding sleeve 308 and the sub 302 and thereby prevent fluid migration through the ports 306 and into the sub 302 when the sliding sleeve 308 is in the closed position. Similar to the dynamic seal 216 of FIGS. 2A-2B, the dynamic seals 314*a,b* may be made of a variety of materials including, but not limited to, elastomers, metals, composites, rubbers, ceramics, derivatives thereof, and any combination thereof. Moreover, one or both of the dynamic seals 314*a,b* may be an O-ring, as illustrated, but may alternatively be a set of v-rings or CHEVRON® packing rings, or other appropriate seal configurations (e.g., seals that are round, v-shaped, u-shaped, square, oval, t-shaped, etc.), as generally known to those skilled in the art, or any combination thereof.

In some embodiments, as illustrated, the assembly 300 may further include a securing mechanism 316 configured to secure the sliding sleeve 308 in the open position. In the illustrated embodiment, the securing mechanism 316 may be a snap ring arranged within a groove 318 defined in the sliding sleeve 308 at or near its downhole end. In the closed position, the securing mechanism 316 may radially bias the inner surface of the sub 302. Upon moving the sliding sleeve 308 to the open position, however, the securing mechanism 316 may eventually locate and expand into axial contact with a shoulder 320 defined on the inner surface of the sub 302. As expanded into the shoulder 320, the securing mechanism 316 may remain partially disposed within the groove 318, and thereby prevent the sliding sleeve 308 from moving axially back toward the closed position.

The sliding sleeve 308 may further include a sleeve profile 322 defined on its inner radial surface. Similar to the dart profile 208 of FIGS. 2A-2B, the sleeve profile 322 may include or otherwise provide various features, designs, and/or configurations in order to enable the sliding sleeve 308 to mate with a correspondingly configured wellbore dart, and thereby help move the sliding sleeve 308 from the closed position to the open position. For instance, as shown in the illustrated embodiment, the sleeve profile 322 may include one or more radial recesses 324 (shown as first and second radial recesses 324*a* and 324*b*) separated by one or more radial protrusions 326 (one shown). The radial recesses 324*a,b* may exhibit any predetermined or desired length or dimension in order to selectively mate with a corresponding wellbore dart. For instance, in at least one embodiment, the radial recesses 324*a,b* may be configured to mate with the first and second collet portions 210*a,b*, respectively.

Moreover, while only one radial protrusion 326 is depicted in FIGS. 3A-3B, those skilled in the art will readily appreciate that more than one radial protrusion 326 may be defined on the inner surface of the sliding sleeve 308, without departing from the scope of the disclosure. In such embodiments, the number of radial recesses 324*a,b* would also increase proportionally. In other embodiments, the radial protrusion 326 may be replaced with one or more grooves defined in the inner surface of the sliding sleeve 308. In yet other embodiments, a combination of one or more grooves and one or more radial protrusions may be used in the sleeve profile 322, without departing from the scope of the disclosure. Accordingly, the sleeve profile 322 may exhibit a variety of different designs and/or configurations in order to allow the sliding sleeve 308 to be selectively matable with a correspondingly configured dart profile of a wellbore dart.

Exemplary operation of the assembly 300 in moving the sliding sleeve 308 from the closed position (FIG. 3A) to the open position (FIG. 3B) is now provided. In the illustrated embodiment, the wellbore dart 200 described above in FIGS. 2A-2B is introduced into the work string 114 (FIG. 1) and conveyed to the assembly 300. In some embodiments, the wellbore dart 200 may be pumped to the assembly 300 from the surface 104 (FIG. 1) using hydraulic pressure. In other embodiments, the wellbore dart 200 may be dropped through the work string 114 from the surface 104 until locating the assembly 300. In yet other embodiments, the wellbore dart 200 may be conveyed through the work string 114 by wireline, slickline, coiled tubing, etc., or it may be self-propelled until locating the assembly 300. In even further embodiments, any combination of the foregoing techniques may be employed to convey to the wellbore dart 200 to the assembly 300.

Upon locating the assembly 300, the downhole end 214 of the wellbore dart 214 may be configured to enter a seal bore 328 provided on the inner radial surface of the sliding sleeve 308. As illustrated, the seal bore 328 may be arranged downhole from the sleeve profile 322, but may equally be arranged on either end (or at an intermediate location) of the sliding sleeve 308, without departing from the scope of the disclosure. The dynamic seal 216 of the wellbore dart 200 may be configured to engage and seal against the seal bore 328, thereby allowing fluid pressure behind the wellbore dart 200 to increase.

The dart profile 208 of the wellbore dart 200 may be configured to match or otherwise correspond to the sleeve profile 322 of the sliding sleeve 308. Accordingly, upon locating the assembly 300, the dart profile 208 may mate with and otherwise engage the sleeve profile 322, thereby effectively stopping the downhole progression of the wellbore dart 200. More particularly, the first and second collet portions 210*a,b* of the dart profile 208 may exhibit lengths, sizes, and/or configurations that are able to axially and radially align with the first and second radial recesses 324*a,b* of the sleeve profile 322. Furthermore, the groove 212 of the dart profile 208 may exhibit a size, axial location, and/or configuration (e.g., depth) such that it is able to axially align with the radial protrusion 326 of the sleeve profile 322. As a result, once the dart profile 208 axially and radially aligns with the sleeve profile 322, the collet fingers 204 of the wellbore dart 200 may be configured to spring radially outward and thereby mate the wellbore dart 200 to the sliding sleeve 308.

With the dart profile 208 successfully mated with the sleeve profile 322, an operator may increase the fluid pressure within the work string 114 (FIG. 1) uphole from the wellbore dart 200 to move the sliding sleeve 308 to the open position. More particularly, the dynamic seal 216 of the wellbore dart 200 may be configured to substantially prevent the migration of high-pressure fluids past the wellbore dart 200 in the downhole direction. As a result, fluid pressure uphole from the wellbore dart 200 may be increased. Moreover, the one or more shearable devices 310 may be configured to maintain the sliding sleeve 308 in the closed position until assuming a predetermined shear load. As the fluid pressure increases within the work string 114, the increased pressure acts on the wellbore dart 200, which, in turn, acts on the sliding sleeve 308 via the mating engagement between the dart profile 208 and the sleeve profile 322. Accordingly, increasing the fluid pressure within the work string 114 may serve to increase the shear load assumed by the shearable devices 310 holding the sliding sleeve 308 in the closed position.

The fluid pressure may increase until reaching a predetermined pressure threshold, which results in the predetermined shear load being assumed by the shearable devices 310 and their subsequent failure. Once the shearable devices 310 fail, the sliding sleeve 308 may be free to axially translate within the sub 302 to the open position, as shown in FIG. 3B. With the sliding sleeve 308 in the open position, the ports 306 are exposed and a well operator may then be able to perform one or more wellbore operations, such as stimulating a surrounding formation (e.g., the formation 108 of FIG. 1). Following stimulation operations, in at least one embodiment, a drill bit or mill (not shown) may be introduced downhole to drill out the wellbore dart 200, thereby facilitating fluid communication past the assembly 300.

Figure 4:
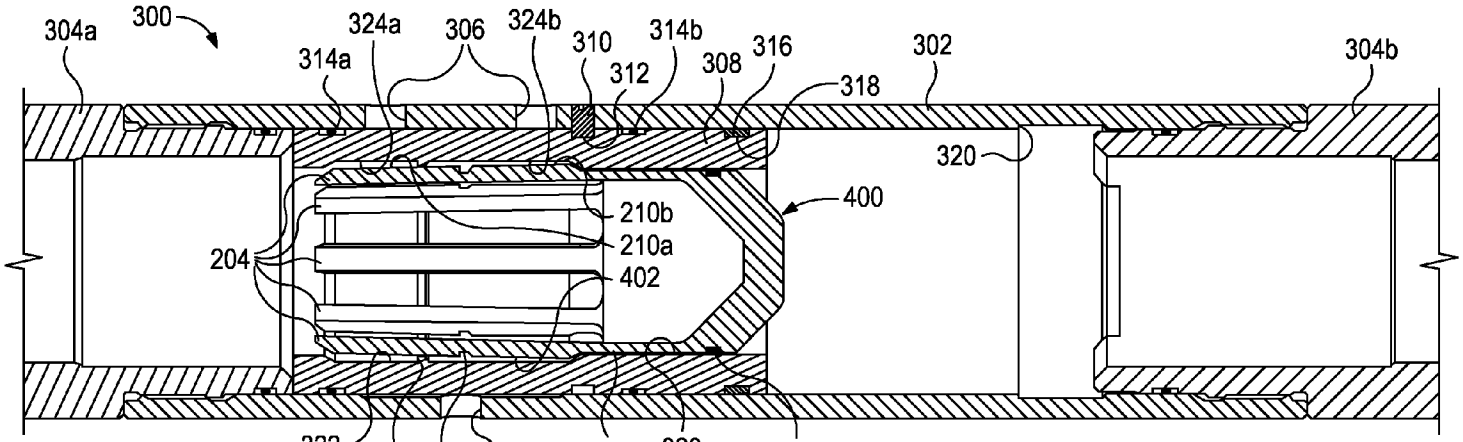
FIG. 4 illustrates another embodiment of the sliding sleeve assembly of FIGS. 3A-3B, according to one or more embodiments.

Referring now to FIG. 4, with continued reference to FIGS. 3A and 3B, illustrated is another exemplary embodiment of the assembly 300, according to one or more embodiments. In the illustrated embodiment, the sliding sleeve 308 is depicted in its closed position and a wellbore dart 400 is conveyed to the assembly 300. The wellbore dart 400 may be similar in some respects to the wellbore dart 200 of FIGS. 2A-2B and therefore may be best understood with reference thereto, where like numerals represent like components or elements. For example, similar to the wellbore dart 200, the wellbore dart 400 may include the body 202, the plurality of collet fingers 204 extending from the body 202, and the dynamic seal 216 arranged about the exterior of the body 202.

Unlike the wellbore dart 200, however, the wellbore dart 400 may include a dart profile 402 that fails to match or is otherwise unable to correspond to the sleeve profile 322 of the sliding sleeve 308. As a result, the wellbore dart 400 is unable to mate with the sliding sleeve 308. This mismatch between the dart profile 402 and the sleeve profile 322 is shown in FIG. 5A. More particularly, FIG. 5A depicts an enlarged cross-sectional side view of the wellbore dart 400 within the sliding sleeve 308. The remaining components of the assembly 300 are omitted for clarity.

As depicted in FIG. 5A, the first and second collet portions 210*a,b* of the dart profile 402 exhibit lengths, sizes, and/or configurations that are able to axially align or otherwise mate with the first and second radial recesses 324*a,b* of the sleeve profile 322. Furthermore, the groove 212 of the dart profile 402 fails to exhibit a size, axial location, and/or configuration (e.g., depth) such that it is would be able to axially align with the radial protrusion 326 of the sleeve profile 322. As a result, the collet fingers 204 of the wellbore dart 200 are unable to spring radially outward once the dart profile 402 locates the sleeve profile 322. Instead, when the wellbore dart 400 encounters the sliding sleeve 308, the collet fingers 204 may be forced radially inward (i.e., flexed, bent, etc.) by the sleeve profile 322, thereby allowing the wellbore dart 400 to pass axially through the assembly 300.

Figure 5B:
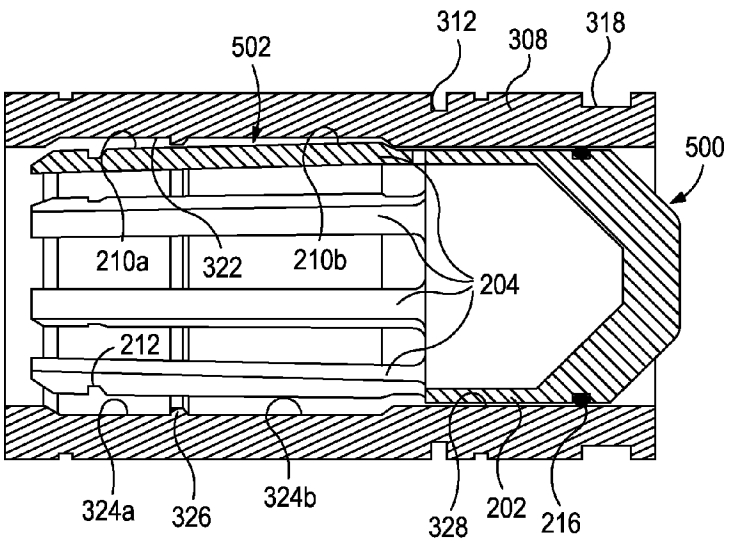
FIG. 5B illustrates an enlarged cross-sectional side view of another profile mismatch between a wellbore dart and a sliding sleeve, according to one or more embodiments.
Figure 5A:
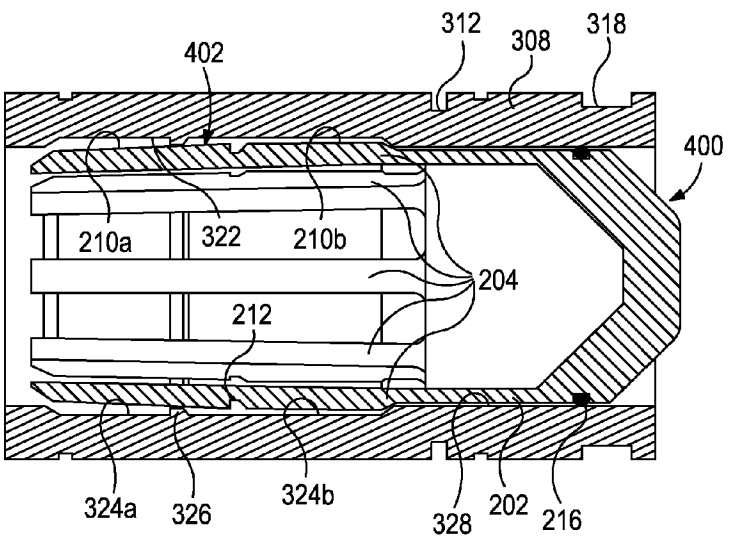
FIG. 5A illustrates an enlarged cross-sectional side view of the profile mismatch between the wellbore dart and sliding sleeve of the sliding sleeve assembly of FIG. 4, according to one or more embodiments.

Referring now to FIG. 5B, with continued reference to FIGS. 3A-3B, 4, and 5B, illustrated is another wellbore dart 500 having a dart profile 502 the results in another mismatch with the sleeve profile 322 of the sliding sleeve 308. More particularly, FIG. 5B depicts an enlarged cross-sectional side view of the wellbore dart 500 within the sliding sleeve 308. As illustrated, the dart profile 502 does not match the sleeve profile 322, as the first and second collet portions 210*a,b* of the dart profile 502 exhibit lengths, sizes, and/or configurations that are unable able to axially align or otherwise mate with the first and second radial recesses 324*a,b* of the sleeve profile 322. Furthermore, the groove 212 of the dart profile 502 fails to exhibit a size, axial location, and/or configuration (e.g., depth) such that it is would be able to axially align with the radial protrusion 326 of the sleeve profile 322. As a result, when the wellbore dart 500 encounters the sliding sleeve 308, the collet fingers 204 may be forced radially inward (i.e., flexed, bent, etc.) by the sleeve profile 322, thereby allowing the wellbore dart 500 to pass axially through the sliding sleeve 308.

In the embodiments depicted in FIGS. 5A and 5B, the dart profiles 402, 502, respectively, are unable to mate with the sleeve profile 322 because they are differently configured. Advantageously, however, the wellbore darts 400, 500 may be configured to match or otherwise correspond to the sleeve profile of another sliding sleeve (not shown) located further downhole within the work string 114 (FIG. 1). Accordingly, after failing to mate with and therefore passing through the sliding sleeve 308, each wellbore dart 400, 500 may continue further downhole until locating a corresponding sleeve assembly having a sliding sleeve configured to properly mate with the dart profiles 402, 502.

Accordingly, in accordance with the present disclosure, a well operator may be able to introduce a wellbore dart into a work string, and the wellbore dart may be configured to selectively engage a corresponding sliding sleeve by mating the dart profile with a matching or corresponding sleeve profile. If the dart profile does not match the sleeve profile of a sliding sleeve it encounters downhole, the collet fingers may collapse radially inwards and pass through the "wrong" sliding sleeve until it encounters a sliding sleeve that exhibits the matching or corresponding sleeve profile. As a result, only the correct wellbore dart will properly engage and actuate the predetermined or "target" sliding sleeve to shift the sliding sleeve to the open position.

Those skilled in the art will readily appreciate the advantages that this may provide. For instance, the presently disclosed system of introducing wellbore darts downhole may allow having the same sized minimum (sealing) inner diameters across all the zones being fractured in a multistage fracture completion operation. The selective nature of the wellbore darts in mating only with a correspondingly configured sliding sleeve may enable the use of just a single size of sealing diameter and wellbore dart system across all zones. The designed selectivity of each wellbore dart may also remove the limitation on the maximum number of zones that may be fractured in a multistage fracture completion operation. Rather, each sliding sleeve assembly may exhibit the same inner diameter across all the zones and depths, thereby eliminating the gradually tapering diameters needed in prior art frac ball systems.

Following stimulation operations, as generally described above, a drill bit or mill may be introduced downhole to drill out the various wellbore darts to a common inner diameter, and thereby facilitate fluid communication back to the surface for production operations. While important, those skilled in the art will readily recognize that this process requires valuable time and resources. According to the present disclosure, however, the wellbore darts may be made at least partially of a dissolvable and/or degradable material to obviate the time-consuming requirement of drilling out wellbore darts in order to facilitate fluid communication therethrough. As used herein, the term "degradable material" refers to any material or substance that is capable of or otherwise configured to degrade or dissolve following the passage of a predetermined amount of time or after interaction with a particular downhole environment (e.g., temperature, pressure, downhole fluid, etc.), treatment fluid, etc.

Referring again to FIG. 2B, in some embodiments, the entire wellbore dart 200 may be made of a degradable material. In other embodiments, only a portion of the wellbore dart 200 may be made of the degradable material. For instance, in some embodiments, all or a portion of the downhole end 214 of the body 202 may be made of the degradable material. As illustrated, for example, the body 202 may further include a tip 220 that forms an integral part of the body 202 or is otherwise coupled thereto. In the illustrated embodiment, the tip 220 may be threadably coupled to the body 202. In other embodiments, however, the tip 220 may alternatively be welded, brazed, or adhered to the body 202, without departing from the scope of the disclosure. After stimulation operations have completed, the degradable material may dissolve or degrade, thereby leaving a full-bore inner diameter through the sliding sleeve assembly without the need to mill or drill out.

Suitable degradable materials that may be used in accordance with the embodiments of the present disclosure include polyglycolic acid and polylactic acid, which tend to degrade by hydrolysis as the temperature increase. Other suitable degradable materials include oil-degradable polymers, which may be either natural or synthetic polymers and include, but are not limited to, polyacrylics, polyamides, and polyolefins such as polyethylene, polypropylene, polyisobutylene, and polystyrene. Other suitable oil-degradable polymers include those that have a melting point that is such that it will dissolve at the temperature of the subterranean formation in which it is placed.

In addition to oil-degradable polymers, other degradable materials that may be used in conjunction with the embodiments of the present disclosure include, but are not limited to, degradable polymers, dehydrated salts, and/or mixtures of the two. As for degradable polymers, a polymer is considered to be "degradable" if the degradation is due to, in situ, a chemical and/or radical process such as hydrolysis, oxidation, or UV radiation. Suitable examples of degradable polymers that may be used in accordance with the embodiments of the present invention include polysaccharides such as dextran or cellulose; chitins; chitosans; proteins; aliphatic polyesters; poly(lactides); poly(glycolides); poly(E-caprolactones); poly(hydroxybutyrates); poly(anhydrides); aliphatic or aromatic polycarbonates; poly(orthoesters); poly (amino acids); poly(ethylene oxides); and polyphosphazenes. Of these suitable polymers, as mentioned above, polyglycolic acid and polylactic acid may be preferred.

Polyanhydrides are another type of particularly suitable degradable polymer useful in the embodiments of the present invention. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Blends of certain degradable materials may also be suitable. One example of a suitable blend of materials is a mixture of polylactic acid and sodium borate where the mixing of an acid and base could result in a neutral solution where this is desirable. Another example would include a blend of poly(lactic acid) and boric oxide. The choice of degradable material also can depend, at least in part, on the conditions of the well, e.g., wellbore temperature. For instance, lactides have been found to be suitable for lower temperature wells, including those within the range of 60° F. to 150° F., and polylactides have been found to be suitable for well bore temperatures above this range. Also, poly (lactic acid) may be suitable for higher temperature wells. Some stereoisomers of poly(lactide) or mixtures of such stereoisomers may be suitable for even higher temperature applications. Dehydrated salts may also be suitable for higher temperature wells.

In other embodiments, the degradable material may be a galvanically corrodible metal or material configured to degrade via an electrochemical process in which the galvanically corrodible metal corrodes in the presence of an electrolyte (e.g., brine or other salt fluids in a wellbore). Suitable galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium.

Embodiments disclosed herein include:

A. A wellbore dart that includes a body having a downhole end, a dynamic seal arranged about an exterior of the body at or near the downhole end, a plurality of collet fingers extending longitudinally from the body, and a dart profile defined on an outer surface of the plurality of collet fingers, the dart profile being configured to selectively mate with a corresponding sleeve profile of a sliding sleeve.

B. A sliding sleeve assembly that includes a sliding sleeve sub coupled to a work string extended within a wellbore, the sliding sleeve sub having one or more ports defined therein that enable fluid communication between an interior and an exterior of the work string, a sliding sleeve arranged within the sliding sleeve sub and movable between a closed position, where the sliding sleeve occludes the one or more ports, and an open position, where the sliding sleeve has moved to expose the one or more ports, a sleeve profile defined on an inner surface of the sliding sleeve, a wellbore dart having a body and a plurality of collet fingers extending longitudinally from the body, and a dart profile defined on an outer surface of the plurality of collet fingers, the dart profile being configured to selectively mate with the sleeve profile.

C. A method that includes introducing a first wellbore dart into a work string extended within a wellbore, the first wellbore dart having a first body, a first plurality of collet fingers extending longitudinally from the first body, and a first dart profile defined on an outer surface of the first plurality of collet fingers, advancing the wellbore dart to a first sliding sleeve assembly arranged in the work string, the first sliding sleeve assembly including a first sliding sleeve sub having one or more ports defined therein, a first sliding sleeve arranged within the first sliding sleeve sub, and a first sleeve profile defined on an inner surface of the first sliding sleeve, mating the first dart profile with the first sleeve profile, increasing a fluid pressure within the work string, and moving the first sliding sleeve from a closed position, where the first sliding sleeve occludes the one or more ports, to an open position, where the one or more ports are exposed.

Each of embodiments A, B, and C may have one or more of the following additional elements in any combination: Element 1: wherein the dynamic seal is arranged within a groove defined on the exterior of the body. Element 2: wherein the dart profile is defined by features selected from the group consisting of one or more collet sections encompassing a corresponding one or more axial lengths of the plurality of collet fingers, one or more grooves defined in the outer surface of the plurality of collet fingers, and one or more radial protrusions defined in the outer surface of the plurality of collet fingers. Element 3: wherein at least a portion of the body is made from a material selected from the group consisting of iron, an iron alloy, steel, a steel alloy, aluminum, an aluminum alloy, copper, a copper alloy, plastic, a composite material, a degradable material, and any combination thereof. Element 4: wherein the degradable material is a material selected from the group consisting of degradable polymers, oil-degradable polymers, dehydrated salts, a galvanically-corrodible metal, and any combination thereof. Element 5: wherein the degradable polymer is at least one of polyglycolic acid and polylactic acid. Element 6: further comprising a tip disposed at the downhole end of the body, the tip being made from a degradable material selected from the group consisting of a galvanically-corrodible metal, polyglycolic acid, polylactic acid, and any combination thereof.

Element 7: wherein the sliding sleeve is secured in the closed position with one or more shearable devices configured to fail upon assuming a predetermined shear load applied by the sliding sleeve. Element 8: further comprising a seal bore defined on the inner surface of sliding sleeve, and a dynamic seal arranged about an exterior of the body at or near a downhole end of the body, the dynamic seal being configured to seal against the seal bore. Element 9: wherein the dart profile includes at least one of one or more collet sections configured to mate with a corresponding one or more radial recesses defined in the sleeve profile, one or more grooves configured to mate with a corresponding one or more radial protrusions defined in the sleeve profile, and one or more radial protrusions configured to mate with a corresponding one or more grooves defined in the sleeve profile. Element 10: wherein at least a portion of the body of the wellbore dart is made from a material selected from the group consisting of iron, an iron alloy, steel, a steel alloy, aluminum, an aluminum alloy, copper, a copper alloy, plastic, a composite material, a degradable material, and any combination thereof. Element 11: wherein the degradable material is a material selected from the group consisting of a galvanically-corrodible metal, polyglycolic acid, polylactic acid, and any combination thereof. Element 12: wherein the sliding sleeve is a first sliding sleeve, the sleeve profile is a first sleeve profile, the wellbore dart is a first wellbore dart, and the dart profile is a first dart profile, the sliding sleeve assembly further comprising a second wellbore dart having a second body and a second plurality of collet fingers extending longitudinally from the second body, and a second dart profile defined on an outer surface of the second plurality of collet fingers, the second dart profile being mismatched with the first sleeve profile but configured to selectively mate with a second sleeve profile of a second sliding sleeve.

Element 13: wherein advancing the first wellbore dart to the first sliding sleeve assembly comprises pumping the first wellbore dart to the first sliding sleeve assembly from a surface location. Element 14: further comprising inserting a downhole end of the first wellbore dart into a seal bore defined on the first sliding sleeve, and sealing against the seal bore with a dynamic seal arranged about an exterior of the first body at or near the downhole end. Element 15: wherein mating the first dart profile with the first sleeve profile comprises at least one of mating one or more collet sections of the first dart profile with a corresponding one or more radial recesses defined in the first sleeve profile, mating one or more grooves of the first dart profile with a corresponding one or more radial protrusions defined in the first sleeve profile, and mating one or more radial protrusions of the first dart profile with a corresponding one or more groove defined in the first sleeve profile. Element 16: wherein the first sliding sleeve is secured in the closed position with one or more shearable devices, and wherein increasing the fluid pressure within the work string comprises increasing the fluid pressure to a predetermined pressure threshold, applying a predetermined shear load on the first sliding sleeve as mated with the first wellbore dart, the predetermined shear load being derived from the predetermined pressure threshold, assuming the predetermined shear load on the shearable devices such that the shearable devices fail and thereby allow the first sliding sleeve to move to the open position. Element 17: wherein at least a portion of the first body of the first wellbore dart is made from a degradable material selected from the group consisting of a galvanically-corrodible metal, polyglycolic acid, polylactic acid, and any combination thereof, the method further comprising allowing the degradable material to degrade. Element 18: wherein introducing the first wellbore dart into the work string is preceded by introducing a second wellbore dart into the work string, the second wellbore dart having a second body, a second plurality of collet fingers extending longitudinally from the second body, and a second dart profile defined on an outer surface of the second plurality of collet fingers, advancing the second wellbore dart to the first sliding sleeve assembly, bypassing the first sliding sleeve assembly with the second wellbore dart, the second dart profile being mismatched to the first sleeve profile, advancing the second wellbore dart to a second sliding sleeve assembly arranged in the work string downhole from the first sliding sleeve assembly, the second sliding sleeve assembly including a second sliding sleeve sub having one or more ports defined therein, a second sliding sleeve arranged within the second sliding sleeve sub, and a second sleeve profile defined on an inner surface of the second sliding sleeve, mating the second dart profile with the second sleeve profile, increasing a fluid pressure within the work string, and moving the second sliding sleeve from a closed position, where the second sliding sleeve occludes the one or more ports defined in the second sliding sleeve sub, to an open position, where the one or more ports defined in the second sliding sleeve sub are exposed. Element 19: wherein at least a portion of the second body of the second wellbore dart is made from a degradable material selected from the group consisting of a galvanically-corrodible metal, polyglycolic acid, polylactic acid, and any combination thereof, the method further comprising allowing the degradable material to degrade.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A wellbore dart, comprising: a body having a downhole end and an integral tip:

a dynamic seal arranged about an exterior of the body at or near the downhole end, the integral tip being configured to prevent migration of fluid past the wellbore dart:

a plurality of collet fingers extending longitudinally from the body; and a dart profile defined on an outer surface of the plurality of collet fingers, the dart profile being configured to selectively mate with a corresponding sleeve profile of a sliding sleeve.

2. The wellbore dart of claim 1, wherein the dynamic seal is arranged within a groove defined on the exterior of the body.

3. The wellbore dart of claim 1, wherein the dart profile is defined by features selected from the group consisting of:

one or more collet sections encompassing a corresponding one or more axial lengths of the plurality of collet fingers;

one or more grooves defined in the outer surface of the plurality of collet fingers; and one or more radial protrusions defined in the outer surface of the plurality of collet fingers.

4. The wellbore dart of claim 1, wherein at least a portion of the body is made from a material selected from the group consisting of iron, an iron alloy, steel, a steel alloy, aluminum, an aluminum alloy, copper, a copper alloy, plastic, a composite material, a degradable material, and any combination thereof.

5. The wellbore dart of claim 4, wherein the degradable material is a material selected from the group consisting of degradable polymers, oil-degradable polymers, dehydrated salts, a galvanically-corrodible metal, and any combination thereof.

6. The wellbore dart of claim 5, wherein the degradable polymer is at least one of polyglycolic acid and polylactic acid.

7. The wellbore dart of claim 1, the integral tip comprising a degradable material selected from the group consisting of a galvanically-corrodible metal, polyglycolic acid, polylactic acid, and any combination thereof.

8. A sliding sleeve assembly, comprising:

a sliding sleeve sub coupled to a work string extended within a wellbore, the sliding sleeve sub having one or more ports defined therein that enable fluid communication between an interior and an exterior of the work string;

a sliding sleeve arranged within the sliding sleeve sub and movable between a closed position, where the sliding sleeve occludes the one or more ports, and an open position, where the sliding sleeve has moved to expose the one or more ports; a sleeve profile defined on an inner surface of the sliding sleeve; a wellbore dart having a body with an integral tip and a plurality of collet fingers extending longitudinally from the body, the integral tip being configured to prevent migration of fluid past the wellbore dart: and a dart profile defined on an outer surface of the plurality of collet fingers, the dart profile being configured to selectively mate with the sleeve profile.

9. The sliding sleeve assembly of claim 8, wherein the sliding sleeve is secured in the closed position with one or more shearable devices configured to fail upon assuming a predetermined shear load applied by the sliding sleeve.

10. The sliding sleeve assembly of claim 8, further comprising:

a seal bore defined on the inner surface of sliding sleeve; and a dynamic seal arranged about an exterior of the body at or near a downhole end of the body, the dynamic seal being configured to seal against the seal bore.

11. The sliding sleeve assembly of claim 8, wherein the dart profile includes at least one of:

one or more collet sections configured to mate with a corresponding one or more radial recesses defined in the sleeve profile;

one or more grooves configured to mate with a corresponding one or more radial protrusions defined in the sleeve profile; and one or more radial protrusions configured to mate with a corresponding one or more grooves defined in the sleeve profile.

12. The sliding sleeve assembly of claim 8, wherein at least a portion of the body of the wellbore dart is made from a material selected from the group consisting of iron, an iron alloy, steel, a steel alloy, aluminum, an aluminum alloy, copper, a copper alloy, plastic, a composite material, a degradable material, and any combination thereof.

13. The sliding sleeve assembly of claim 12, wherein the degradable material is a material selected from the group consisting of a galvanically-corrodible metal, polyglycolic acid, polylactic acid, and any combination thereof.

14. The sliding sleeve assembly of claim 8, wherein the sliding sleeve is a first sliding sleeve, the sleeve profile is a first sleeve profile, the wellbore dart is a first wellbore dart, and the dart profile is a first dart profile, the sliding sleeve assembly further comprising:

a second wellbore dart having a second body and a second plurality of collet fingers extending longitudinally from the second body; and a second dart profile defined on an outer surface of the second plurality of collet fingers, the second dart profile being mismatched with the first sleeve profile but configured to selectively mate with a second sleeve profile of a second sliding sleeve.

15. A method, comprising:

introducing a first wellbore dart into a work string extended within a wellbore, the first wellbore dart having a first body with an integral tip preventing the migration of, fluid past the first wellbore dart, a first plurality of collet fingers extending longitudinally from the first body, and a first dart profile defined on an outer surface of the first plurality of collet fingers;

advancing the wellbore dart to a first sliding sleeve assembly arranged in the work string, the first sliding sleeve assembly including a first sliding sleeve sub having one or more ports defined therein, a first sliding sleeve arranged within the first sliding sleeve sub, and a first sleeve profile defined on an inner surface of the first sliding sleeve;

mating the first dart profile with the first sleeve profile;

increasing a fluid pressure within the work string; and moving the first sliding sleeve from a closed position, where the first sliding sleeve occludes the one or more ports, to an open position, where the one or more ports are exposed.

16. The method of claim 15, wherein advancing the first wellbore dart to the first sliding sleeve assembly comprises pumping the first wellbore dart to the first sliding sleeve assembly from a surface location.

17. The method of claim 15, further comprising:

inserting a downhole end of the first wellbore dart into a seal bore defined on the first sliding sleeve; and sealing against the seal bore with a dynamic seal arranged about an exterior of the first body at or near the downhole end.

18. The method of claim 15, wherein mating the first dart profile with the first sleeve profile comprises at least one of:

mating one or more collet sections of the first dart profile with a corresponding one or more radial recesses defined in the first sleeve profile;

mating one or more grooves of the first dart profile with a corresponding one or more radial protrusions defined in the first sleeve profile; and mating one or more radial protrusions of the first dart profile with a corresponding one or more groove defined in the first sleeve profile.

19. The method of claim 15, wherein the first sliding sleeve is secured in the closed position with one or more shearable devices, and wherein increasing the fluid pressure within the work string comprises:

increasing the fluid pressure to a predetermined pressure threshold;

applying a predetermined shear load on the first sliding sleeve as mated with the first wellbore dart, the predetermined shear load being derived from the predetermined pressure threshold; and assuming the predetermined shear load on the shearable devices such that the shearable devices fail and thereby allow the first sliding sleeve to move to the open position.

20. The method of claim 15, wherein at least a portion of the first body of the first wellbore dart is made from a degradable material selected from the group consisting of a galvanically-corrodible metal, polyglycolic acid, polylactic acid, and any combination thereof, the method further comprising allowing the degradable material to degrade.

21. The method of claim 15, wherein introducing the first wellbore dart into the work string is preceded by:

introducing a second wellbore dart into the work string, the second wellbore dart having a second body, a second plurality of collet fingers extending longitudinally from the second body, and a second dart profile defined on an outer surface of the second plurality of collet fingers;

advancing the second wellbore dart to the first sliding sleeve assembly;

bypassing the first sliding sleeve assembly with the second wellbore dart, the second dart profile being mismatched to the first sleeve profile;

advancing the second wellbore dart to a second sliding sleeve assembly arranged in the work string downhole from the first sliding sleeve assembly, the second sliding sleeve assembly including a second sliding sleeve sub having one or more ports defined therein, a second sliding sleeve arranged within the second sliding sleeve sub, and a second sleeve profile defined on an inner surface of the second sliding sleeve;

mating the second dart profile with the second sleeve profile;

increasing a fluid pressure within the work string; and moving the second sliding sleeve from a closed position, where the second sliding sleeve occludes the one or more ports defined in the second sliding sleeve sub, to an open position, where the one or more ports defined in the second sliding sleeve sub are exposed.

22. The method of claim 21, wherein at least a portion of the second body of the second wellbore dart is made from a degradable material selected from the group consisting of a galvanically-corrodible metal, polyglycolic acid, polylactic acid, and any combination thereof, the method further comprising allowing the degradable material to degrade.

* * * * *